US007469687B2

(12) United States Patent
Mai et al.

(10) Patent No.: US 7,469,687 B2
(45) Date of Patent: Dec. 30, 2008

(54) METHOD AND DEVICE FOR OPERATING AN INTERNAL COMBUSTION ENGINE

(75) Inventors: Wolfgang Mai, Eschborn (DE); Jens Pache, Kelkheim (DE); Markus Roth, Schwalbach (DE); Gerd Rösel, Regensburg (DE)

(73) Assignee: Siemens Aktiengesellschaft, Munich (DE)

( * ) Notice: Subject to any disclaimer, the term of this patent is extended or adjusted under 35 U.S.C. 154(b) by 204 days.

(21) Appl. No.: 11/634,025

(22) Filed: Dec. 5, 2006

(65) Prior Publication Data

US 2008/0141982 A1 Jun. 19, 2008

(51) Int. Cl.
*F02M 33/02* (2006.01)
*F02M 33/04* (2006.01)

(52) U.S. Cl. ..... 123/520

(58) Field of Classification Search ..... 123/520, 123/519, 518, 516, 521, 198 D; 137/587, 137/588, 589, 493, 43; 701/115
See application file for complete search history.

(56) References Cited

U.S. PATENT DOCUMENTS

| | | | | |
|---|---|---|---|---|
| 5,609,141 | A * | 3/1997 | Matsuoka et al. | 123/520 |
| 5,682,862 | A * | 11/1997 | Sato et al. | 123/520 |
| 5,988,151 | A | 11/1999 | Schneider | |
| 2004/0045538 | A1 * | 3/2004 | Tagami et al. | 123/520 |

FOREIGN PATENT DOCUMENTS

| | | |
|---|---|---|
| DE | 197 01 353 C1 | 3/1998 |
| WO | WO 97/35106 A2 | 9/1997 |

* cited by examiner

*Primary Examiner*—Mahmoud Gimie
(74) *Attorney, Agent, or Firm*—Baker Botts L.L.P.

(57) ABSTRACT

To operate an internal combustion engine subvolumes of the fluid flowing into an intake duct in each instance during a predetermined time period are determined for each period. Tank purging values of a characteristic quantity are determined for each period. The characteristic quantity is representative of a tank purging fuel mass, which flowed through the tank purging valve in each instance during the predetermined time period. The successive subvolumes are added together, starting from the currently determined subvolume, to give a total subvolume, until the total subvolume is greater than or equal to an effective intake duct volume downstream of the tank purging valve.

16 Claims, 3 Drawing Sheets

METHOD AND DEVICE FOR OPERATING AN INTERNAL COMBUSTION ENGINE

CROSS REFERENCE TO RELATED APPLICATIONS

This application claims the benefits of German Patent application No. 10 2005 058 225.7 filed Dec. 6, 2005. All of the applications are incorporated by reference herein in their entirety.

FIELD OF INVENTION

The invention relates to a method and device for operating an internal engine .

BACKGROUND OF THE INVENTION

The performance and efficiency of internal combustion engines are subject to increasingly strict requirements. At the same time increasingly stringent legal provisions require pollutant emissions to be kept low. To this end it is known that internal combustion engines can be fitted with a plurality of control elements to adjust the level in the respective combustion chambers of the cylinders of the internal combustion engine, the level before combustion comprising a mixture of air, fuel and in some instances also exhaust gases. Phase adjustment facilities for example are known, which can be used to change a phase between a crankshaft and a camshaft of the internal combustion engine, thereby changing the respective start and end of the opening or closing of the gas inlet and gas outlet valves. Valve lift adjustment facilities are also known, which can be used to adjust a valve lift of the gas inlet valve or even a gas outlet valve of the internal combustion engine between a low and high valve lift.

Internal combustion engines are also regularly fitted with tank purging devices, by means of which fuel evaporation emissions from a tank in a vehicle, in which the internal combustion engine can be disposed, are buffered in an active carbon store. What is known as a tank purging valve is used at regular intervals to regenerate the active carbon store. The tank purging valve thereby releases a connection to the intake duct of the internal combustion engine. The fuel bound in the active carbon store can thus flow into the intake duct of the internal combustion engine and be combusted in the respective cylinder of the internal combustion engine. For precise operation of the internal combustion engine with low emissions, it is essential that such additionally incorporated fuel is also taken into accurate account.

SUMMARY OF INVENTION

The object of the invention is to create a method and device, which allow precise operation of an internal combustion engine.

The object is achieved by the features of the independent claims. Advantageous embodiments of the invention are characterized in the subclaims.

The invention is characterized by a method and a corresponding device for operating an internal combustion engine with an intake duct, which opens into at least one inlet of at least one cylinder. A tank purging valve is also provided, which is configured to control the initiation of a tank purging flow into the intake duct at an inlet point upstream of the respective inlet of the respective cylinder. Subvolumes of the fluid flowing into the intake duct in each instance during a predetermined time period are determined for each period.

Tank purging values of a characteristic quantity are determined for each period, the characteristic quantity being representative of a tank purging fuel mass, which flowed through the tank purging valve in each instance during the predetermined time period. The successive subvolumes, starting from the currently determined subvolume, are added together to give a total subvolume, until the total subvolume is greater than or equal to an effective intake duct volume downstream of the tank purging valve. A cylinder tank purging fuel mass is determined, which flows into a cylinder during the working cycle of the respective cylinder of relevance to a previous measuring in of fuel. The cylinder tank purging fuel mass is determined as a function of the tank purging value, which is at an interval from the currently determined tank purging value that is equal to the number of added together subvolumes of the totaled subvolume starting from the said currently determined tank purging value. The cylinder tank purging fuel mass is therefore determined as a function of the tank purging value, which was determined according to the number of periods preceding the added together subvolumes of the totaled subvolume for such a period. This means that the cylinder tank purging fuel mass can be determined in a particularly simple manner and then taken into account accordingly when calculating the fuel mass to be measured into the combustion chamber of the cylinder by way of an injection valve. It is then possible on the one hand to purge the fuel vapors occurring in the tank in an emission-neutral manner and on the other hand it is simple to ensure that there is no increase in pollutant emissions as a result.

According to one advantageous embodiment of the invention the respective subvolumes are determined in relation to a reference pressure and the effective intake duct volume is determined as a function of an intake pipe pressure in the intake duct. It is thus possible to avoid having to recalculate the respective subvolumes already determined in the past again in each instance in the event of changes in the intake pipe pressure in respect of the changed intake pipe pressure, simply adjusting the intake duct volume accordingly, so that it ultimately corresponds to a virtual effective intake duct volume. It is thus possible to operate the internal combustion engine with little computation outlay, even in the case of largely non-stationary operation. This is also particularly advantageous in conjunction with a variable valve train for gas inlet and/or gas outlet valves, as very dynamic changes can occur in the intake pipe pressure here.

According to a further advantageous embodiment of the invention the respective subvolumes are determined in relation to a reference temperature and the effective intake duct volume is determined as a function of a temperature of the fluid in the intake duct. It is thus possible, even with very significant temperature fluctuations, for example in particular in very largely non-stationary operation, to avoid having to adjust the respective subvolumes to the current respective temperature with the effective intake duct volume simply having to be corrected instead. This allows the internal combustion engine to be operated with relatively little computation outlay even where there are significant temperature fluctuations.

According to a further advantageous embodiment of the invention the subvolumes are buffered in a volume ring memory. This allows particularly simple implementation with optimized computation.

According to a further advantageous embodiment of the invention the tank purging values are buffered in a tank purging ring memory. This allows particularly simple implementation with optimized computation.

BRIEF DESCRIPTION OF THE DRAWINGS

Exemplary embodiments of the invention are described in more detail below with reference to the schematic drawings, in which.

Elements of identical structure or function are shown with the same reference characters in all the figures.

DETAILED DESCRIPTION OF INVENTION

Figure 1:
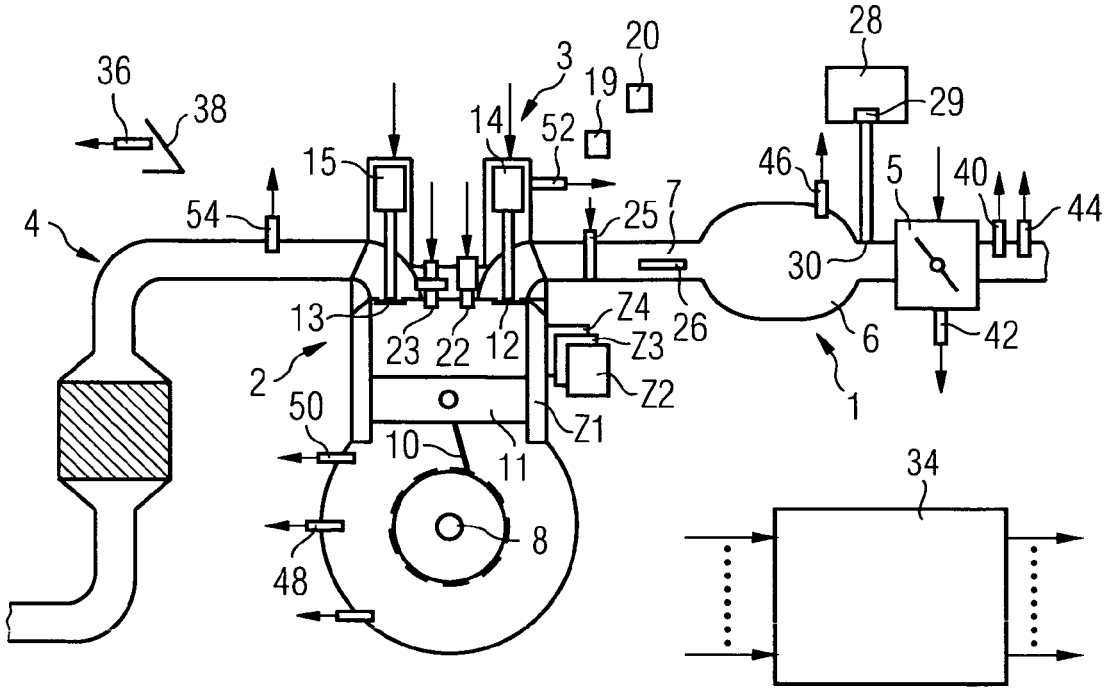
FIG. 1 shows an internal combustion engine with a control device.

An internal combustion engine (FIG. 1) comprises an intake duct 1, an engine block 2, a cylinder head 3 and an exhaust gas duct 4. The intake duct 1 preferably comprises a throttle valve 5, also a manifold 6 and an intake pipe 7, running to a cylinder Z1 by way of an inlet channel into the engine block 2. The engine block 2 further comprises a crankshaft 8, which is coupled by way of a connecting rod 10 to the piston 11 of the cylinder Z1.

The cylinder head 3 comprises a valve train with a gas inlet valve 12, a gas outlet valve 13 and valve drives 14, 15.

A camshaft is provided, which acts by way of cams on the gas inlet valve 12 and the gas outlet valve 13. A separate camshaft is preferably assigned to the gas inlet valve 12 and gas outlet valve 13 respectively. A valve lift adjustment facility 19 can also be provided, which is configured such that it can be used to vary the valve lift of the gas inlet valve 12. It can for example be configured such that it can either cause a first cam to act on a plunger of the gas inlet valve with the result that the gas inlet valve then performs a low valve lift or such that it can cause a further cam to act on the plunger of the gas inlet valve 12 with the result that the gas inlet valve 12 performs a high valve lift. The valve lift of the gas inlet valve 12 performed during a working cycle of the respective cylinder Z1 therefore varies depending on the valve lift position VL. The valve lift adjustment facility 19 can also be configured to vary the valve lift of the gas inlet valve 12 continuously. This allows a mode of operation, in which the load is controlled by varying the valve lift of the gas inlet valve.

A phase adjustment facility 20 can also be provided, by means of which a crankshaft angle range can be changed during a working cycle of the respective cylinder, in which the gas inlet valve 12 releases the inlet. This also allows what is known as a valve overlap to be set, which is characterized in that both the gas inlet valve and the gas outlet valve release the inlet or outlet of the cylinder at the same time.

The cylinder head 3 further comprises an injection valve 22 and a spark plug 23. Alternatively the injection valve 22 can also be disposed in the intake pipe 7.

A pulse charging valve 25 can also be disposed in the intake duct 1 or in the inlet to the cylinder Z1 respectively, sealing or releasing either the respective intake pipe, in which it is disposed, or the respective inlet, depending on its position. Such a pulse charging valve 25 can be used to improve the gas level of the cylinder Z1. The pulse charging valve 25 can also be used for load adjustment by corresponding variation of its activation times.

A switching device 26 can also be provided in the intake duct 1 to set an effective intake pipe length. The switching device can thus be configured as a switching flap for example, allowing or purging communication between individual intake pipes, which are assigned to different cylinders of the internal combustion engine, or alternatively allowing air to be supplied by way of different sections of the same intake pipe or different intake pipes. Such a switching device can also be configured such that, depending on its position, a free volume in the intake duct 1, which is available to take air into the cylinder 1, can be changed, thereby changing the effective intake duct volume.

The internal combustion engine also comprises a tank purging device 28, which buffers fuel vapors from a tank system of the internal combustion engine in a storage unit, which is preferably configured as an active carbon store, and then regenerates the storage unit in appropriate operating situations of the internal combustion engine. To this end the tank purging device 28 has a tank purging valve 29. With the tank purging valve 29 in the open position, a tank purging flow enriched with fuel can flow from the tank purging device into the intake duct 1 by way of an inlet point 30, which opens downstream of the throttle valve 5 into the intake duct 1. With the tank purging valve 29 in the closed position there is no tank purging flow into the intake duct 1. In an alternative embodiment of the internal combustion engine there may for example be no throttle valve present either. In this instance—but also when the throttle valve 5 is present—the inlet point 30 can open into the intake duct at any point, where there is suitable pressure during operation of the internal combustion engine to ensure that the tank purging flow flows away into the intake duct. A region close by and downstream of an air filter for example is possible for this purpose, in particular when there is a charging device present with a compressor in the intake duct 1.

A control device 34 is also provided, to which sensors are assigned, which capture different measured variables and the value of the measured variable in each instance. The control device determines manipulated variables as a function of at least one of the measured variables, said manipulated variables then being converted to one or more actuating signals to control the control elements by means of corresponding actuating drives. The control device 34 can also be referred to as a device for controlling or operating the internal combustion engine.

The sensors are a pedal position sensor 36, which captures the position of a gas pedal 38, an air mass sensor 40, which captures an air mass flow upstream of the throttle valve 5, a throttle valve position sensor 42, which captures an opening angle THR of the throttle valve 5, a first temperature sensor 44, which captures an intake air temperature T_IM, an intake pipe pressure sensor 46, which captures an intake pipe pressure P_IM in the manifold 6, a crankshaft angle sensor 48, which captures a crankshaft angle, to which a rotation speed N is then assigned. A second temperature sensor 50 captures a coolant temperature. A camshaft angle sensor 52 is also provided, which captures a camshaft angle. If there are two camshafts present, a camshaft angle sensor 52 is preferably assigned to each camshaft. An exhaust gas probe 54 is also preferably provided, to capture the residual oxygen content of the exhaust gas, with a measurement signal that is characteristic of the air/fuel ratio in the cylinder Z1.

Depending on the embodiment of the invention, it is possible for any subset of said sensors to be present or additional sensors may also be present.

The control elements are for example the throttle valve 5, the gas inlet and gas outlet valves 12, 13, the valve lift adjustment facility 19, the phase adjustment facility 20, the injection valve 22, the spark plug 23, the pulse charging valve 25, the switching device 26 for setting an effective intake pipe length or the tank purging valve 29.

In addition to the cylinder Z1 further cylinders Z2 to Z4 are preferably also provided, to which corresponding control elements and optionally sensors are also assigned.

Figure 2:
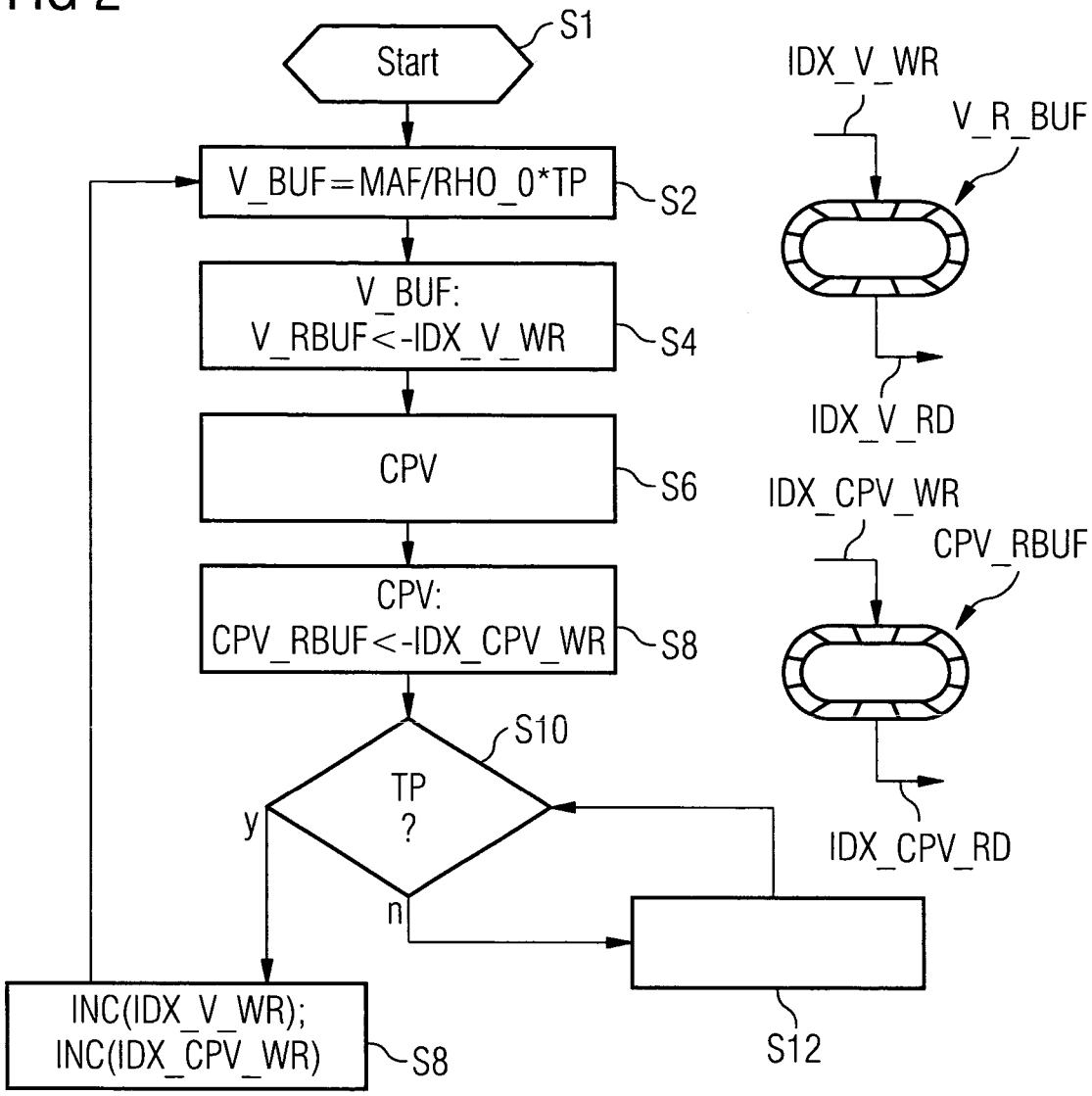
FIG. 2 shows a first flow diagram for operating the internal combustion engine and FIG. 3 shows a second flow diagram for operating the internal combustion engine.

A flow diagram of a first program for operating the internal combustion engine is described in more detail below with reference to the flow diagram in FIG. 2. The program is started in a step S1, in which variables can optionally be initialized. The start preferably takes place at a time close to the time of an engine start of the internal combustion engine.

In a step S2 a subvolume V_BUF of the fluid flowing into the intake duct 1 during a time period TP is determined. The subvolume V_BUF is preferably determined according to the formula specified in step S2. MAF here refers to the air mass flow, which flows into the intake duct and therefore the one flowing past the inlet point in the intake duct, in particular past the throttle valve 5, and flowing through the tank purging valve 29 into the intake duct 1. It can for example be captured directly using the air mass sensor 40 and a further air mass meter of the tank purging system optionally disposed downstream of the tank purging valve 29 but it can also be derived partially from other measured variables using a corresponding physical model. RHO_0 refers to a reference density of the fluid flowing in, having a value of 1.225 kg/m$^3$ for example. TP refers to the time period, which can be predetermined permanently for example in a range between 5 and 50 ms, thus for example 20 ms. The formula in step S2 corresponds to the ideal gas equation.

In a step S4 the subvolume V_BUF determined in step S2 is then stored in a volume ring memory V_RBUF, in a memory position, which is predetermined by a write pointer IDX_V_WR. The volume ring memory V_RBUF can for example comprise 50 memory locations for storing different subvolumes V_BUF. It can for example be implemented specifically in the form of an array or even preferably in the form of a data structure with pointers to the respective next element. The volume ring memory V_RBUF is characterized in that a predetermined number of subvolumes V_BUF respectively, which were calculated during preceding runs of step S2, are buffered herein and can therefore be called up but the memory location is nevertheless limited and the oldest determined values are automatically overwritten in each instance.

In a step S6 a tank purging value CPV is determined, for a characteristic quantity, which is representative of a tank purging fuel mass, which flowed through the tank purging valve in each instance during the predetermined time period (TP) or which in particular flowed into the intake duct 1 in each instance during the predetermined time period TP by way of the inlet point 30 to initiate the tank purging flow. The characteristic quantity is preferably a fuel concentration in relation to the air mass flowing in during the time period, said air mass also including fuel. This can preferably be done using a corresponding physical model of the tank purging system. To this end for example a concentration of fuel vapors present in the tank can be determined as an estimated value and the tank purging value CPV can then be determined as a function of the opening angle of the tank purging valve 29. The air mass flowing in by way of the throttle valve 5 is then also taken into account in this context. The tank purging value CPV is preferably a tank purging fuel concentration, which is representative of a tank purging fuel mass. Alternatively however the tank purging value CPV can be the tank purging fuel mass directly.

In a step S8 the determined tank purging value CPV is stored in a tank purging ring memory CPV_RBUF, in a memory position, which is predetermined by a write pointer IDX_CPV_WR. The tank purging ring memory CPV_RBUF is preferably set up in a corresponding manner to the volume ring memory V_R_BUF and in particular comprises the same number of memory points.

In a step S10 it is checked whether the time period TP has elapsed since step S2 was last processed. The check in step S10 should in particular be based primarily on whether the measured variables for determining the subvolume V_BUF and the tank purging value CPV were last captured for the preceding time period TP and whether this period has elapsed. It should in particular be ensured that the corresponding measured variables for determining the subvolume V_BUF and the tank purging value CPV were captured at the right time for every predetermined time period TP and are then captured again for the next time period TP. If the condition in step S10 is not met, processing continues in a step S12, in which the program freezes for a predetermined waiting period, before processing resumes in step S10.

If however the condition in step S10 is met, in a step S14 the write pointer IDX_V_WR and also the write pointer IDX_CPV_WR for the volume ring memory or the tank purging ring memory CPV_RBUF are incremented. Depending on the configuration of the respective ring memory V_RBUF, CPV_RBUF, this can involve an increase in the index value of an array or the displacement of the pointer to the next memory point in the respective ring memory V_RBUF or CPV_RBUF. This process is generally referred to as incrementation INC of the respective write pointer IDX_V_WR or IDX_CPV_WR. Processing then continues in step S2.

Figure 3:
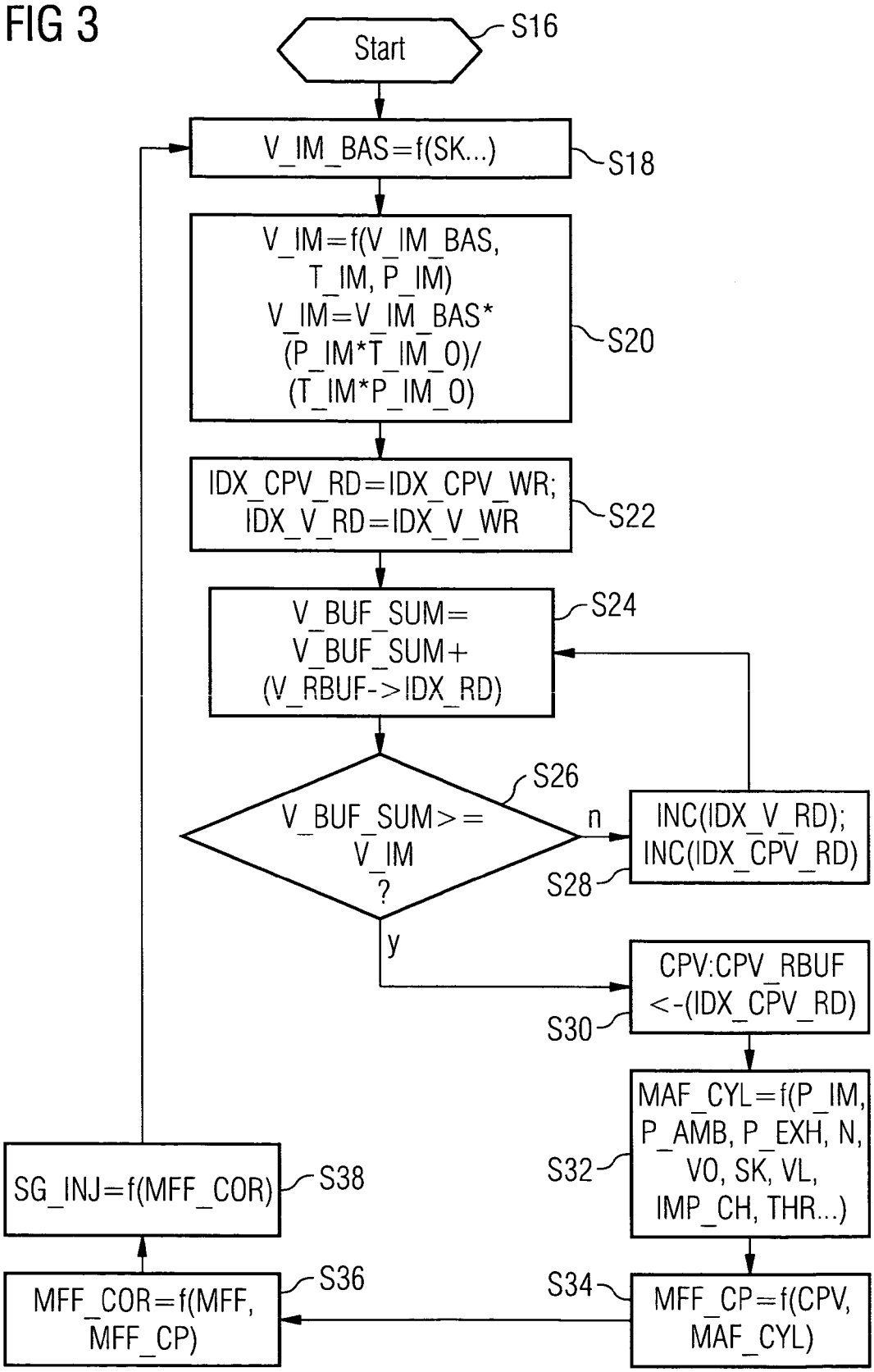

The program according to FIG. 2 preferably runs almost parallel in time to a further program for operating the internal combustion engine, which is described in more detail below with reference to the flow diagram in FIG. 3.

The program is started in a step S16, in which variables are optionally initialized. The start preferably also takes place at a time close to the time when the internal combustion engine starts.

In a step S18 an effective basic intake duct volume V_IM_BAS is determined. The effective basic intake duct volume V_IM_BAS corresponds to a free volume of the intake duct 1 downstream of the tank purging valve 29 up to the inlet into the combustion chamber of the respective cylinder Z1 to Z4. If the throttle valve 5 and an inlet point 30 disposed in proximity downstream of the throttle valve 5 are present, the free volume of the intake duct 1 can also extend from downstream of the throttle valve 5 up to the inlet into the combustion chamber of the respective cylinder Z1 to Z4. If control elements are present, by means of which the actual volume, which can be changed by the fluid on its path to the inlet of the combustion chamber of the respective cylinder Z1 to Z4, this is taken into account in the calculation in step S18. To this extent the effective basic intake duct volume V_IM_BAS is determined, for example as a function of a switching device position SK of the switching device 26 or further control elements, which influence the corresponding effective basic intake duct volume V_IM_BAS. In the simplest instance however the effective basic intake duct volume V_IM_BAS is predetermined permanently.

In a subsequent step S20 an effective intake duct volume V_IM is determined as a function of the effective basic intake duct volume V_IM_BAS, the intake air temperature T_IM in the intake duct 1 and the intake pipe pressure P_IM. This is preferably done using the formula specified in step S20. P_IM_0 represents a reference intake pipe pressure, which can for example be 1013 hectopascals, and T_IM_0 represents a reference intake air temperature T_IM_0 of for example 288° K. The reference intake air temperature T_IM_0 is representative of a reference temperature of a fluid in the intake duct. The intake air temperature T_IM is representative of a temperature of the fluid in the intake duct.

The formula in step S20 is finally used to determine a virtual intake duct volume, which is adjusted to the respective current intake at temperatures T_IM and the current intake pipe pressure P_IM.

In a step S22 a read pointer IDX_CPV_RD for reading from the tank purging ring memory CPV_RBUF is set in the same manner as the corresponding write pointer IDX_CPV_WR. Correspondingly in step S22 a read pointer IDX_V_RD for reading from the volume ring memory V_RBUF is set in the same manner as the write pointer IDX_V_WR, which is assigned to the volume ring memory V_RBUF. In step S22 a totaled subvolume V_BUF_SUM is preferably assigned a neutral value, in particular zero.

In a step S24 the subvolume V_BUF, which can be read using the read pointer IDX_V_RD, is added to the totaled subvolume V_BUF_SUM. During the first run through the step S24 the subvolume V_BUF determined before the last run in time through step S4 is therefore added to the totaled subvolume V_BUF_SUM.

In a step S26 it is then checked whether the totaled subvolume V_BUF_SUM is greater than or equal to the effective intake duct volume V_IM. If this is not the case, the corresponding read pointers IDX_V_RD and IDX_CPV_RD are incremented in step S28, in a corresponding manner to the procedure in step S14. Processing then continues again in step S24.

If however the condition of step S26 is met, the number of subvolumes V_BUF added together corresponds approximately to the effective intake duct volume V_IM. This is representative of the last respective subvolume V_BUF, which was used to total the totaled subvolume V_BUF_SUM, being representative in respect of its assigned tank purging value CPV of the concentration of the tank purging fuel mass, which flows into the respective cylinder during the working cycle of said cylinder of relevance to a previous measuring in of fuel.

In a step S30 the value in the tank purging ring memory CPV_RBUF, to which the corresponding read pointer IDX_CPV_RD points, is therefore assigned to the tank purging value CPV.

In a step S32 a gas mass flow MAF_CYL into the combustion chamber of the respective cylinder Z1 to Z4 is determined, preferably using an intake pipe level model. To this end an intake pipe level model can for example be provided, which can be used to determine the gas mass flow MAF_CYL into the combustion chamber of the respective cylinder Z1 to Z4 and optionally also the intake pipe pressure P_IM precisely, even in non-stationary operating phases of the internal combustion engine.

Such an intake pipe level mode is known to the person skilled in the art, for example from the pertinent specialist manual "Handbuch Verbrennungsmotor, Grundlagen, Komponenten, Systeme, Perspektiven" (Manual for internal combustion engines, principles, components, systems, perspectives), Richard van Basshuysen/Fred Schafer, $2^{nd}$ edition 2002, Vieweg & Sohn Verlagsgesellschaft mbH, Braunschweig/Wiesbaden, pages 557-559, the content of which is herewith incorporated in this respect. Such an intake pipe level model is similarly known from WO 97/35106 A2, the content of which is similarly incorporated herewith in this respect.

The gas mass flow MAF_CYL is determined using a sectionally linear approach as a function of the intake pipe pressure P_IM. The individual straight sections of this sectionally linear approach differ in their respective offset and straight line angle. The respective offset and straight line angle are stored in characteristic maps as a function of an ambient pressure P_AMB and/or an exhaust gas counterpressure P_EXH and/or the rotation speed N and/or the valve overlap VO and/or the switching device position SK and/or the valve lift position and/or the pulse charging valve position IMP_CH and optionally further variables. The characteristic maps are determined beforehand by corresponding experimentation on an engine test bed or by simulation and stored in a data storage unit of the control device 34.

The intake pipe pressure P_IM is determined as a function of the gas mass flow MAF_CYL into the combustion chamber of the respective cylinder Z1 to Z4, the rotation speed N, the throttle valve opening angle THR, the intake air temperature T_IM, the ambient pressure P_AMB, the switching device position SK, the exhaust gas counterpressure P_EXH, the exhaust gas temperature T_EXH and optionally further variables or even a subset of said variables.

The exhaust gas counterpressure P_EXH can be estimated simply using a further model as a function of the respectively injected fuel mass and/or the gas mass MAF_CYL supplied into the combustion chamber of the respective cylinder.

The ambient pressure P_AMB can either be captured directly using a suitable pressure sensor. Alternatively however it can also be captured by the intake pipe pressure sensor 46 in a position of the throttle valve 5, in which said throttle valve 5 almost does not throttle the intake air. The exhaust gas temperature T_EXH is either captured directly using a suitably disposed further temperature sensor or is also estimated as a function of the fuel mass to be measured in and/or the gas mass flow MAF_CYL into the combustion chamber of the respective cylinder Z1 to Z4. Determination of the intake pipe pressure P_IM using the dynamic intake pipe level model is preferably based on a numerical solution to the ideal gas differential equation.

In a step S34 a cylinder tank purging fuel mass MFF_CP is determined as a function of the tank purging value CPV determined in step S30 and the gas mass flow MAF_CYL in the cylinder. If the characteristic quantity for the tank purging value CPV is the tank purging fuel concentration, it is possible to determine the cylinder tank purging fuel mass MFF_CP simply by multiplying the tank purging value CPV by the gas mass flow MAF_CYL into the cylinder. It should be noted in this context that the gas mass flow MAF_CYL is preferably further multiplied by the time period TP, giving the corresponding gas mass.

In a step S36 a fuel mass MFF to be measured in, which is already predetermined by another function as a function of the current load of the internal combustion engine, being measured in for each cylinder segment duration, is corrected appropriately as a function of the currently relevant cylinder tank purging fuel mass MFF_CP, thereby determining a corrected fuel mass MFF_COR to be measured in. Such correction can for example take place as the predetermination of a predetermined air/fuel ratio in the combustion chamber before combustion of the mixture.

A cylinder segment duration is the time required for a working cycle, divided by the number of cylinders Z1 to Z4 in the internal combustion engine. In the case of a four-stroke internal combustion engine with four cylinders for example, the cylinder segment duration results from the inverse of half the rotation speed divided by the number of cylinders in the internal combustion engine.

In a step S38 the corresponding actuating signal SG_INJ to activate the respective injection valve 23 of the respective cylinder Z1 to Z4 is determined as a function of the corrected fuel mass MFF_COR to be measured in. The respective injection valve 23 is then activated according to the actuating signal SG_INJ. Processing then continues again in step S18, in some instances after a predeterminable waiting period or a predeterminable waiting crankshaft angle.

When determining the effective intake duct volume V_IM it is further advantageous in step S20 in some instances also to take into account an influence of the rotation speed and/or the gas mass flow MAF. The procedure according to the flow diagrams in FIGS. 2 and 3 further has the advantage that the calibration outlay drops, as parameterization can be effected based on known measured variables without the vehicle. It is only necessary to validate the results.

The invention claimed is:

1. A method for operating an internal combustion engine having an intake duct connected to an inlet of a cylinder and a tank purging valve configured to control an initiation of a tank purging flow into the intake duct at an inlet point upstream of the respective inlet of the respective cylinder, comprising:

determining subvolumes of a fluid flowing into the intake duct in each instance during a predetermined time period;

determining tank purging values of a characteristic quantity for each of the predetermined time periods;

determining a total subvolume by adding a current subvolume to successive subvolumes until the total subvolume is greater than or equal to an effective intake duct volume downstream of the tank purging valve;

determining a cylinder tank purging fuel mass which flows into a cylinder during a working cycle of a respective cylinder of relevance, wherein the cylinder tank purging fuel mass is determined as a function of the tank purging value that is at an interval from the currently determined tank purging value that is equal to the number of added together subvolumes of the totaled subvolume; and storing the determined cylinder tank purging fuel mass in a memory storage device.

2. The method as claimed in claim 1, wherein the respective subvolumes are determined in relation to a reference intake pipe pressure and the effective intake duct volume is determined as a function of an intake pipe pressure in the intake duct.

3. The method as claimed in claim 2 wherein the respective subvolumes are determined in relation to a reference temperature and the effective intake duct volume is determined as a function of a temperature of the fluid in the intake duct.

4. The method as claimed in claim 3, wherein the subvolumes are buffered in a volume ring memory.

5. The method as claimed in claim 4, wherein the tank purging values are buffered in a tank purging ring memory.

6. A system for operating an internal combustion engine having an intake duct connected to an inlet of a cylinder and a tank purging valve configured to control an initiation of a tank purging flow into the intake duct at an inlet point upstream of the respective inlet of the respective cylinder, comprising:

a subvolume determining device that determines subvolumes of a fluid flowing into the intake duct in each instance during a predetermined time period;

a tank purging value determining device that determines tank purging values of a characteristic quantity for each of the predetermined time periods;

a total subvolume determining device that determines a total subvolume by summing a current subvolume to successive subvolumes until the total subvolume is greater than or equal to an effective intake duct volume downstream of the tank purging valve; and a cylinder tank purging fuel mass determining device that determines the cylinder tank purging fuel mass which flows into a cylinder during the working cycle of the respective cylinder of relevance to a previous measuring in of fuel, and determines the cylinder tank purging fuel mass as a function of the tank purging value, which is at an interval from the currently determined tank purging value that is equal to the number of added together subvolumes of the totaled subvolume starting from said currently determined tank purging value.

7. The system as claimed in claim 6, wherein the respective subvolumes are determined in relation to a reference intake pipe pressure and the effective intake duct volume is determined as a function of an intake pipe pressure in the intake duct.

8. The system as claimed in claim 7, wherein the respective subvolumes are determined in relation to a reference temperature and the effective intake duct volume is determined as a function of a temperature of the fluid in the intake duct.

9. The system as claimed in claim 8, wherein the subvolumes are buffered in a volume ring memory.

10. The system as claimed in claim 9, wherein the tank purging values are buffered in a tank purging ring memory.

11. An internal combustion engine, comprising:

an engine block having a plurality of cylinders defined within the block;

a crank shaft arranged in the engine block below the cylinders;

a plurality of pistons arranged in the cylinders and connected to the crank shaft;

a cylinder head arranged on the engine block opposite the crank shaft and forming a combustion chamber;

a plurality of inlet valves arranged in the cylinder head that regulate the inlet of an inlet flow into the combustion chamber;

a plurality of exhaust valves arranged in the cylinder head that regulate the outlet of an exhaust flow out of the combustion chamber;

an intake duct connected to the cylinder head to provide an inlet flow to the cylinders;

a tank purging device that buffers fuel vapors from a tank system of the engine in a storage unit;

an engine control device that:

determines subvolumes of a fluid flowing into the intake duct in each instance during a predetermined time period, determines tank purging values of a characteristic quantity for each of the predetermined time periods, determines a total subvolume by adding a current subvolume to successive subvolumes until the total subvolume is greater than or equal to an effective intake duct volume downstream of the tank purging valve, and determines a cylinder tank purging fuel mass which flows into a cylinder during a working cycle of the respective cylinder of relevance, wherein the cylinder tank purging fuel mass is determined as a function of the tank purging value that is at an interval from the currently determined tank purging value that is equal to the number of added together subvolumes of the totaled subvolume.

12. The engine as claimed in claim 11, wherein the tank purging device is an active carbon store.

13. The engine as claimed in claim 12, wherein the respective subvolumes are determined in relation to a reference intake pipe pressure and the effective intake duct volume is determined as a function of an intake pipe pressure in the intake duct.

14. The engine as claimed in claim 13, wherein the respective subvolumes are determined in relation to a reference temperature and the effective intake duct volume is determined as a function of a temperature of the fluid in the intake duct.

15. The engine as claimed in claim 14, wherein the subvolumes are buffered in a volume ring memory.

16. The engine as claimed in claim 15, wherein the tank purging values are buffered in a tank purging ring memory.

* * * * *